US007357073B2

(12) United States Patent
Aoshima

(10) Patent No.: US 7,357,073 B2
(45) Date of Patent: Apr. 15, 2008

(54) DRIVE UNIT AND DRIVE METHOD FOR PRESS

(75) Inventor: Kiyoji Aoshima, Komatsu (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 10/458,653

(22) Filed: Jun. 11, 2003

(65) Prior Publication Data

US 2004/0003729 A1 Jan. 8, 2004

(30) Foreign Application Priority Data

Jul. 4, 2002 (JP) ..... 2002-196486

(51) Int. Cl.
*B30B 15/14* (2006.01)
*B21J 7/46* (2006.01)

(52) U.S. Cl. ..... 100/48; 100/273; 100/282; 72/443

(58) Field of Classification Search ..... 100/48, 100/273, 280, 282, 272; 72/441, 444, 429, 72/449, 450, 452.5, 443; 74/89, 15.8, 89.25, 74/572, 572.1; 475/5, 149
See application file for complete search history.

(56) References Cited

U.S. PATENT DOCUMENTS 2,771,790 A * 11/1956 Munschauer ..... 74/665 B
5,127,256 A * 7/1992 Shiga et al. ..... 72/441
5,425,682 A * 6/1995 Hayashi ..... 475/5
5,468,194 A * 11/1995 Hayashi ..... 477/3
6,178,803 B1 * 1/2001 Ozaki et al. ..... 72/443
6,193,625 B1 * 2/2001 Ullrich et al. ..... 475/5
6,443,867 B1 9/2002 Fahrenbach ..... 475/5

FOREIGN PATENT DOCUMENTS

| | | |
|---|---|---|
| DE | 44 21 527 | 12/1995 |
| DE | 196 40 440 | 4/1998 |
| DE | 100 07 505 | 8/2001 |
| JP | 11-58091 | 3/1999 |

OTHER PUBLICATIONS

Communication from the German Patent Office mailed Jul. 12, 2007 with English translation (5 pages).

* cited by examiner

*Primary Examiner*—Jimmy T. Nguyen
(74) *Attorney, Agent, or Firm*—Kratz, Quintos & Hanson, LLP

(57) ABSTRACT

A press drive unit and press drive method are provided which decrease the cycle time of a press to improve its productivity, enable use of small-sized, inexpensive presses and provide improved product quality. To this end, the press drive unit comprises a drive shaft coupled to a slide through a specified power transmission mechanism; a first drive system for rotationally driving a flywheel with a main motor and driving the drive shaft through a clutch disposed between the flywheel and the drive shaft; and a second drive system for driving the drive shaft at variable speed with a sub motor. Driving is carried out with the first and second drive systems in a formation zone, and driving is carried out with the second drive system alone in a non-formation zone.

2 Claims, 6 Drawing Sheets

DRIVE UNIT AND DRIVE METHOD FOR PRESS

TECHNICAL FIELD

The present invention relates to a drive unit and drive method for a press which contribute to an improvement in the cycle time of a press.

BACKGROUND ART

The slide of a press is generally driven such that it is lowered at low speed conformable to processing conditions within the zone of a forming phase and moved at high speed within other zones than the formation zone, whereby the cycle time of the press is decreased to achieve improved productivity. To obtain such slide motion, there has been conventionally used a link drive press in which the slide is driven by the main motor through a complicated link mechanism. The link mechanism of the link drive press is designed to make the speed of the slide within the formation zone alone (formation speed) slow and to make the speed of the slide within other zones (e.g., lifting phase) than the formation zone a bit faster. The speed difference of the link drive press is up to about 30% of the speed difference of the crank press.

Needless to say, improved productivity is one of the most important themes (demands) for press work carried out by the users of press machines. As an attempt to achieve improved productivity, the rotational speed of the slide drive shaft is increased in mechanical presses such as the above-described link drive press. However, increasing of the rotational speed of the drive shaft causes a proportional increase in the slide speed (i.e., touching speed at which the press touches the workpiece) within the formation zone, which brings about the problem that the resulting speed does not meet the desirable forming conditions. In addition, noise occurring when the press touches the workpiece increases. In view of this, the rotational speed of the slide drive shaft cannot be increased so much, and therefore there is a limit to improving productivity.

As a means for solving the above problem, driving of the link mechanism with an electric servo motor is conceivable, but this also reveals such a drawback that a large-sized electric servo motor having larger output torque becomes necessary for generating a pressing force substantially equivalent to a sum of the output torque of the conventional main motor and the accumulating energy of the flywheel. Use of a large-sized servo motor leads to an increase in the cost and size of the overall press machine. Furthermore, in cases where a press that has long been in service is modified (i.e., retrofitting), large-scaled reconstruction becomes necessary to replace the conventional main motor with a large-sized electric servo motor, causing problems such as a prolonged reconstruction period and increased reconstruction cost.

The present invention has been directed to overcoming the above shortcomings, and a primary object of the invention is therefore to provide a press drive unit and a press drive method which improve the cycle time of the press to achieve increased productivity, provide improved product quality and enable use of a small-sized, inexpensive press.

DISCLOSURE OF THE INVENTION

The foregoing object can be accomplished by a press drive unit according to a first aspect of the invention, the press drive unit comprising:

a drive shaft coupled to a slide through a specified power transmission mechanism;

a first drive system for rotationally driving a flywheel with a main motor and driving the drive shaft through a clutch disposed between the flywheel and the drive shaft; and a second drive system for driving the drive shaft at variable speed with a sub motor.

According to the invention, the first drive system is arranged such that dynamic energy is accumulated in the flywheel and discharged through operation of a clutch to drive the slide, while the second drive system drives the slide without use of the clutch, so that the pressing force and optimum formation speed required for the formation zone can be attained while ensuring good response and high speed for slide motion control within the non-formation zone. Thus, both requirements are satisfied. As a result, high quality products can be constantly produced. Even if the driving speed of the press is increased, running time for the feeder can be assured, resulting in an improvement in productivity.

According to a second aspect of the invention, the press drive unit of the first aspect of the invention is modified such that driving is carried out with the first and second drive systems in a formation zone of slide motion, and driving is carried out with the second drive system alone in a non-formation zone.

With this arrangement, in the formation zone of the slide motion, the workpiece is pressurized by a slide pressing force caused by the release of dynamic energy of the flywheel of the first drive system, whereas in the non-formation zone, the flywheel and the main motor are disconnected from the slide by disengaging the clutch and the slide motion is controlled only with the sub motor of the second drive system, so that the power (the maximum output torque) of the sub-motor does not need to be high and, therefore, a small-sized motor can be employed as the sub motor.

In addition, since the sub motor is driven with the flywheel being disconnected therefrom, the control can be performed with fast response and the slide can be driven at high speed after disconnecting the flywheel from the slide subsequently to completion of formation until the next formation zone starts. As a result, overall cycle time can be decreased, leading to an improvement in productivity.

According to a third aspect of the invention, there is provided a press drive method wherein, in a formation zone of slide motion, a main motor for rotatably driving a flywheel drives a slide through a clutch disposed between the flywheel and a slide drive unit, while a sub motor drives the slide drive unit synchronously with the main motor and wherein, in a non-formation zone, driving at variable speed is carried out with the sub motor alone.

In the present invention, during the formation phase, processing can be effectively carried out by releasing dynamic energy accumulated in the flywheel and during the non-formation phase, the slide motion can be controlled by the sub motor alone with the flywheel and the main motor being disconnected therefrom, so that acquisition of a great pressuring force and the optimum formation speed during the formation phase is compatible with speeding-up of the slide motion during the non-formation phase.

BEST MODE FOR CARRYING OUT THE INVENTION

Referring now to the accompanying drawings, a press drive unit and a press drive method will be hereinafter described according to an embodiment of the invention.

Figure 1:
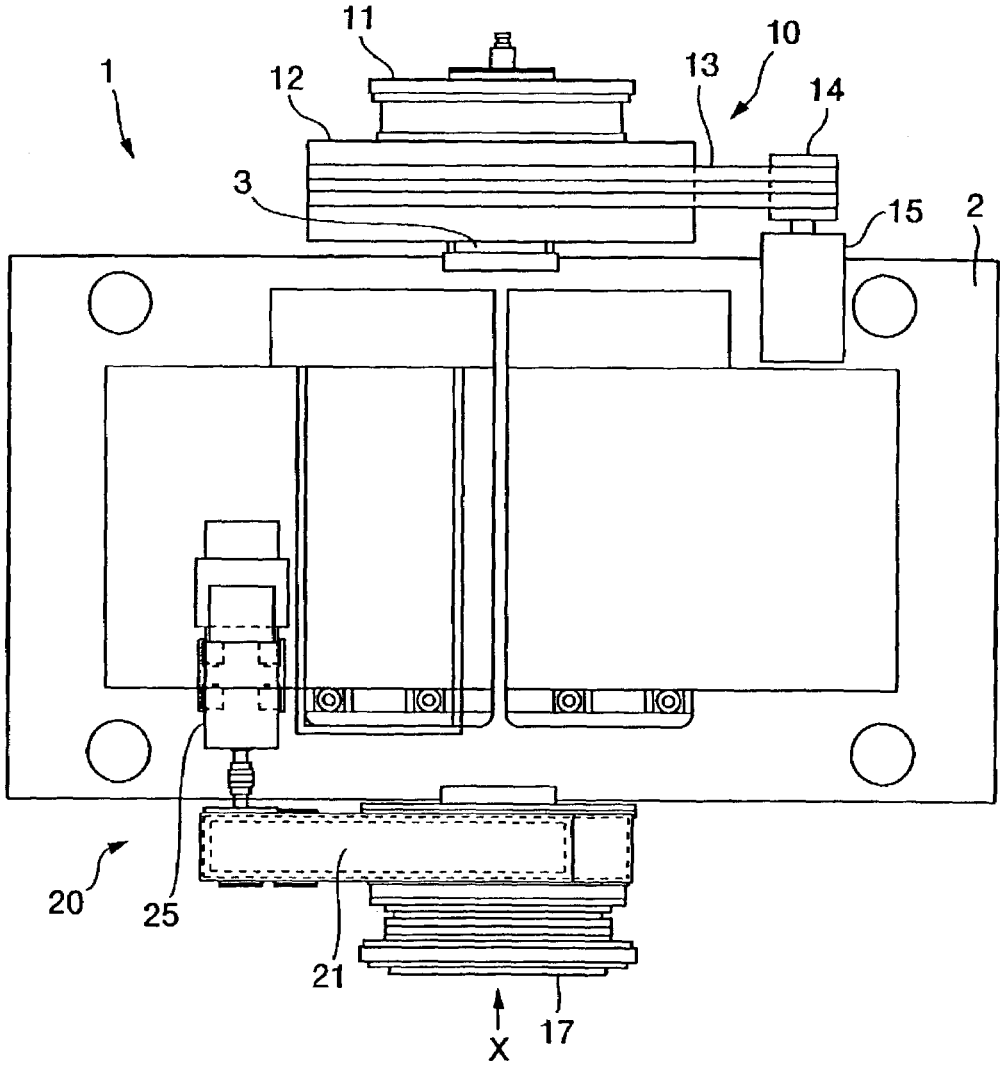
FIG. 1 is a plan view of a crown of a press to which the invention is applied.
Figure 2:
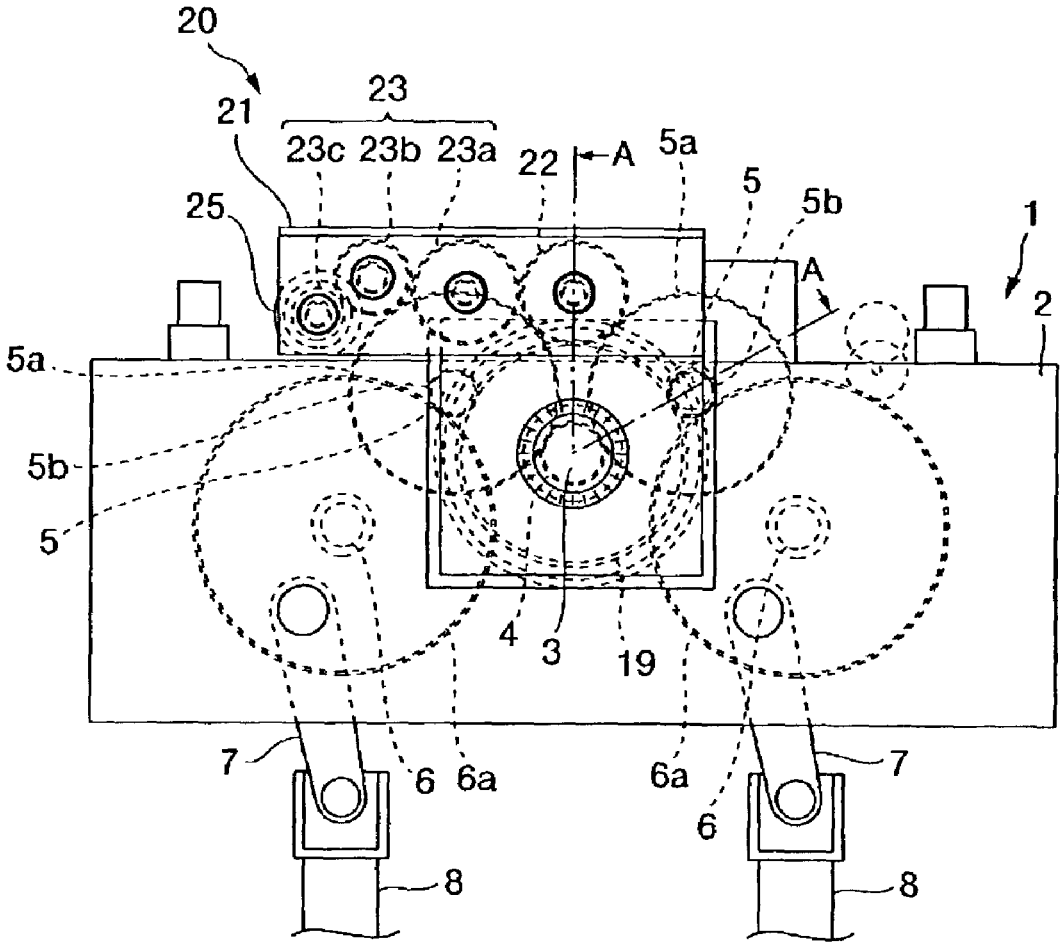
FIG. 2 is a view when viewed from X of FIG. 1.
Figure 3:
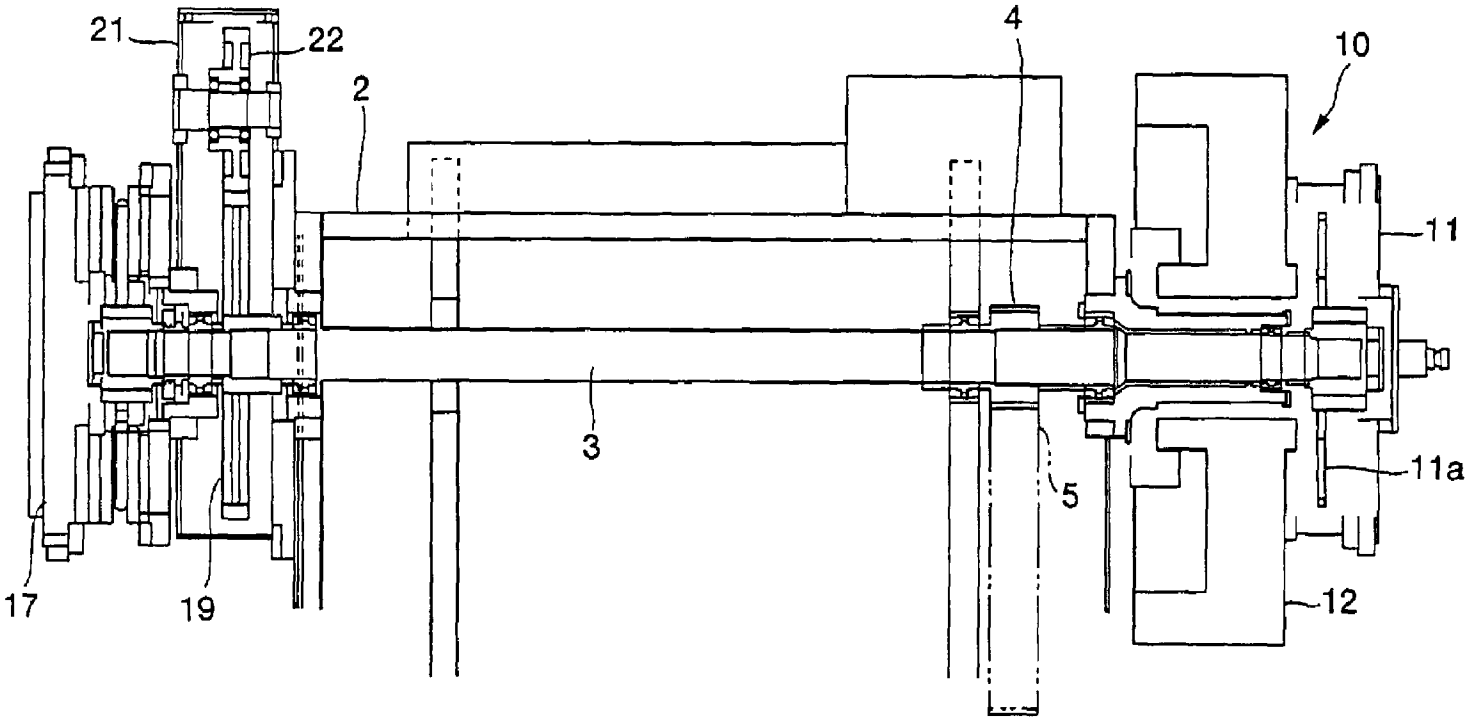
FIG. 3 is a sectional view taken along line A-A of FIG. 2.

First, reference is made to FIGS. 1 to 3 to explain the structure of the slide drive unit of a press to which the invention is applied. FIG. 1 is a plan view of a crown of the press. FIGS. 2 and 3 are a view when viewed from X of FIG. 1 and a sectional view taken along line A-A of FIG. 2, respectively.

According to the present embodiment, disposed within a crown 2 positioned at the upper part of a press 1 is a slide drive unit whose drive shaft 3 is rotatably supported by the frame of the crown 2. At a first end of the drive shaft 3, a first drive system 10 is provided, and at a second end, a second drive system 20 is provided.

More specifically, a clutch 11 for the drive system 10 is mounted on the first end of the drive shaft 3. The clutch 11 has a drive center 11*a* which is provided with a facing (not shown) and attached to the drive shaft 3. There are disposed a fixed disk and a movable disk between which the facing is placed. These disks are designed to rotate together with a flywheel 12. In response to an instruction signal supplied from outside, the movable disk axially moves, comes into engagement with the fixed disk with the facing held between, and rotatably drives the drive shaft 3 through the drive center 11*a*. An annular V-shaped groove is formed on the peripheral face of the flywheel 12 and a V belt 13 is wound around the flywheel 12 and a pulley 14 mounted on the output shaft of a main motor 15 attached to the upper face of the crown 12. Disposed at the second end of the drive shaft 3 is a brake unit 17. The clutch 11, the flywheel 12, the V belt 13 and the main motor 15 constitute the first drive system 10. The main motor 15 accumulates dynamic energy in the flywheel 12 by rotational driving and discharges this energy through operation of the clutch 11 to rotationally drive the drive shaft 3. The main motor 15, the clutch 11 and the brake unit 17 input control signals respectively from a controller 30 (described later).

A gear 19 is attached in the vicinity of the brake unit 17 at the second end of the drive shaft 3, meshing with a gear 22 which is rotatably supported within a gear box 21 attached to a side face of the crown 2 on the side of the second end of the drive shaft 3. The gear 22 is connected to a sub motor 25 disposed on the upper face of the crown 2 through a reducer 23 having a plurality of gear trains 23*a*, 23*b*, 23*c* which are rotatably supported within the gear box 21. The sub motor 25, the reducer 23 and the gear 22 constitute the second drive system 20 and the sub motor 25 rotationally drives the drive shaft 3 through the gears 22 and 19. The sub motor 25 inputs a control signal released from the controller 30 (described later).

Mounted on the intermediate portion of the drive shaft 3 is a gear 4 which interlocks with four main gears 6*a* provided at the front and rear ends of a right and left pair of shafts 6 through gears 5*a*, 5*b*; 5*a*, 5*b*. The gears 5*a*, 5*b*; 5*a*, 5*b* are rotatably supported on the crown 2 by a right and left pair of intermediate axes 5 which are arranged with the drive shaft 3 between. At the position deviating from the center of the shaft 6 of each main gear 6*a*, a plunger 8 is coupled to the main gear 6 through a con' rod 7. The main gears 6*a*, the con' rods 7 and the plungers 8 constitute an eccentric mechanism. Coupled to the undersides of the four plungers 8 are a slide (not shown) which is mounted on a press body frame so as to move up and down.

Figure 4:
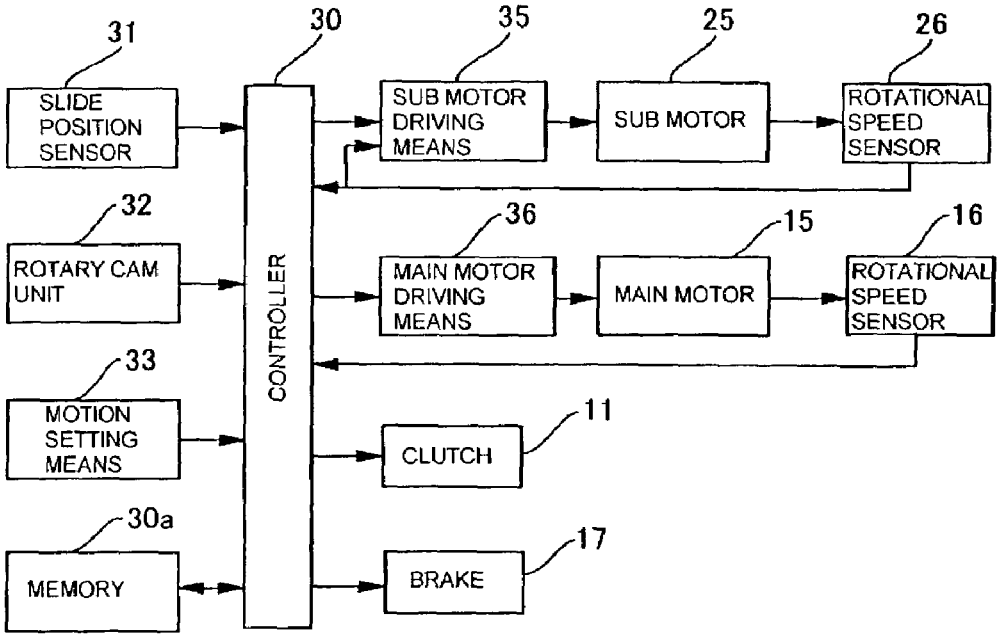
FIG. 4 is a block diagram showing the hard of a control unit according to the invention.

The press having the above structure includes a controller for executing press drive control. Referring to FIG. 4 which is a block diagram showing the hard of the controller according to the present embodiment, the control configuration will be described below.

A slide position sensor 31 for accurately detecting the vertical position of the slide (i.e., the level of the slide from the upper face of the bolster) is provided. The slide position sensor 31 is composed of an absolute encoder attached, for example, to a crank shaft for precisely measuring the crank angle of the slide drive unit, or composed of a linear scale mounted between the slide and the press body frame. The slide position detected by the slide position sensor 31 is sent in the form of a feedback signal during the slide motion control in other zones than the formation zone.

A rotary cam unit 32 for determining the position of the slide in one cycle of the operation of the slide is provided, thereby detecting a timing for switching between the slide motion control for other zones than the formation zone and the synchronization control of two drive systems for the formation zone. The rotary cam unit 32 may be of the rotary cam switch type comprising a timing setting cam mounted on a shaft which rotates, for instance, once per cycle of the slide and a limit switch for detecting the position of the cam. Alternatively, the rotary cam unit 32 may be an electronic rotary cam device. In this device, a rotation angle corresponding to one cycle of the operation of the slide is detected by an encoder and an operation angle range for each electronic rotary cam is preset. And, monitoring is carried out during actual control to check whether or not an angle signal from the encoder falls within the preset angle range and each rotary cam output signal is switched ON or OFF.

Figure 5:
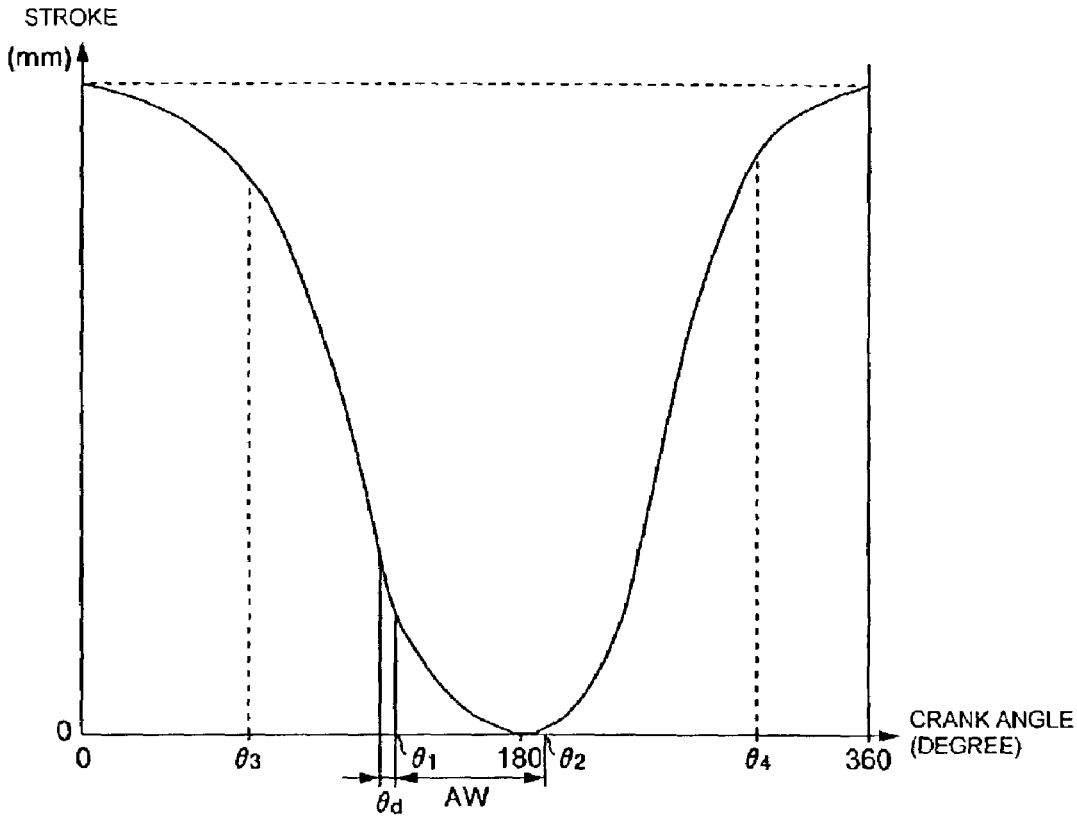
FIG. 5 shows an example of the slide motion of the invention.

There is provided a motion setting means 33 for setting a slide motion in accordance with workpiece processing conditions. As shown in FIG. 5, the slide motion is divided into the formation zone AW and the non-formation zone. Herein, the formation zone AW is the zone which exists in the vicinity of the bottom dead center of the slide and in which the slide is involved in the workpiece formation process, whereas the non-formation zone is zones other than the formation zone AW. At the bottom dead center, the rotation angle (hereinafter referred to as "crank angle" for simplicity) of the main gears 6*a* is 180 degrees, that is, the con' rods 7 are positioned at their lowest positions.

The motion for the formation zone AW is determined by the motor speed Va in this zone and the starting point and terminating point of the zone. Although the starting point and terminating point of this zone are determined by the ON angle (or OFF angle) θ1 of a specified rotary cam signal and the OFF angle (or ON angle) θ2 of the specified rotary cam signal, respectively, setting of these points is not limited to this method, but may be done in other ways. For instance, the starting and terminating points may be determined by crank angle.

The motion for the non-formation zone is determined by the starting points and terminating points of motor constant speed sections (hereinafter referred to as "stages") and the motor speed at each stage (It should be noted that the starting point of each stage is the same as the terminating point of its preceding stage). The number of stages between the terminating point (corresponding to θ2 in FIG. 5) and starting point (corresponding to θ1 in FIG. 5) of the formation zone AW may be one or a plural number. Although the details of the motion in the non-formation zone will be described later, the motion is controlled by the sub motor 25 only, and therefore the motor speed in each stage indicates the speed of the sub motor 25. Similarly to the above case, the starting point and terminating point of each stage are determined by the ON angle (or OFF angle) of a rotary cam signal and the OFF angle (or ON angle) of the rotary cam signal, respectively. FIG. 5 shows the case where four stages are provided which correspond to 0 degree to θ3, θ3 to θ1, θ2 to θ4 and θ4 to 360 degrees (=0 degree).

The main motor 15 for driving the slide through operation of the clutch 11 consists of a controllable-speed motor such as, for instance, a three-phase induction motor. Mounted on the output shaft of the main motor 15 is a first rotational speed sensor 16 for detecting the rotational speed of the main motor 15. A signal indicative of the detected rotational speed is input to the controller 30.

A main motor driving means 36 controls the speed of the main motor 15 in response to a speed instruction from the controller 30. In this example, the main motor driving means 36 is composed of an inverter for controlling the three-phase induction motor serving as the main motor 15.

The sub motor 25 is a servo motor in the present embodiment and is provided with a second rotational speed sensor 26 for detecting the rotational speed of the sub motor 25. A signal indicative of the detected rotational speed is input to the controller 30 and the sub motor driving means 35.

The sub motor driving means 35 of this embodiment is composed of a servo amplifier for controlling the servo motor. In response to a speed instruction from the controller 30, the sub motor driving means 35 controls, based on the difference between the value of the speed instruction and the rotational speed signal fed back from the second rotational speed sensor 26, the speed of the sub motor 25 so as to reduce the difference.

The sub motor 25 may be any motor as far as its speed is controllable. For example, a three-phase induction motor driven by an inverter may be used as the sub motor 25. In this case, the sub motor driving means 35 is composed of an inverter for controlling the speed of the three-phase motor based on a speed instruction.

The brake 17 brakes the rotation of the drive shaft 3 in response to a braking instruction from the controller 30.

A memory 30*a* stores motion data set for every workpiece, such as the motor speed, starting point and terminating point of the formation zone and the motor speed, starting point and terminating point of each stage of the non-formation zone. The memory 30*a* also stores reduction ratios etc. from the outputs shafts of the main motor 15 and the sub motor 25 to the drive shaft 3, the reduction ratios being referred when performing the synchronous control of the main motor 15 and the sub motor 25.

A main component of the controller 30 is a high-speed processor such as a microcomputer and PLC (Programmable Logic Controller, i.e., the so-called programmable sequencer). The controller 30 monitors to check whether the slide is positioned within the formation zone or the non-formation zone during the actual control of the slide, based on a rotary cam signal from the rotary cam unit 32 or a position detection signal from the slide position sensor 31. Based on the slide motion set by the motion setting means 33, the controller 30 controls only the sub motor 25 so as to rotate at the rotational speed preset for each stage when the slide is positioned within the non-formation zone and controls the main motor 15 and the sub motor 25 so as to rotate synchronously at the preset formation speed when the slide comes into the formation zone AW. When switching from the control for the formation zone AW to the control for the non-formation zone or vice versa, the controller 30 outputs an intermittence instruction to the clutch 11 to disconnect or connect the main motor 15. When performing the synchronous control of the main motor 15 and the sub motor 25, the rotational speed of the main motor 15 is input from the first rotational speed sensor 16 whereas the rotational speed of the sub motor 25 is input from the second rotational speed sensor 26, and a speed instruction for the sub motor 25 is calculated to control the sub motor 25 such that the difference between the speeds of the main and sub motors is reduced.

Figure 6:
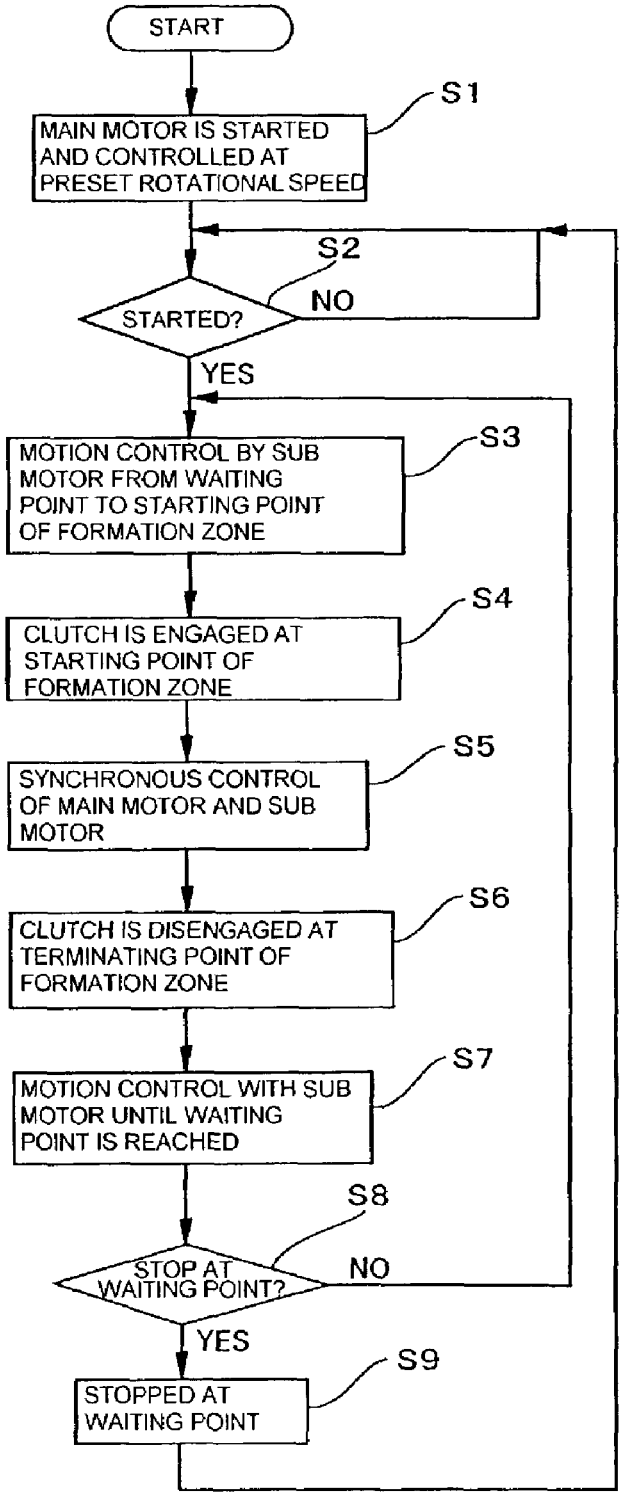
FIG. 6 is a flow chart of control according to one embodiment.

With reference to the control flow chart of FIG. 6, a method of controlling the press 1 of the present embodiment will be discussed.

After a main motor starter switch (not shown) has been turned ON in Step S1, the main motor 15 is controlled to rotate at a motor speed Va which has been preset for the formation zone AW of the motion.

In Step S2, the controller waits until a start-up instruction is input. Herein, the start-up instruction may be an ON signal from an operation button (not shown) or alternatively may be a start-up command from an external management controller or the like. When the start-up instruction has been input, only the sub motor 25 is controlled in Step S3 to rotate at a preset motor speed for each stage of the motion, from the slide waiting point to the starting point (corresponding to crank angle θ1 in the case shown in FIG. 5) of the formation zone AW of the preset motion, with the clutch 11 being disengaged. Then, the motor speed is gradually changed to the motor speed Va for the formation zone AW, starting from a specified distance (a specified angle θd in the case shown in FIG. 5) ahead of the starting point of the formation zone AW, thereby preparing for the synchronous control in the formation zone AW. At that time, the slide moves down at a speed corresponding to the rotational speed of the sub motor 25 at each stage, according to the crank motion of the crank mechanism composed of the gears 6*a*, the con' rods 7 and the plungers 8.

In Step S4, when the slide has reached the starting point of the formation zone AW, the clutch 11 is engaged to perform "two-motor driving" by the synchronous control of the main motor 15 and the sub motor 25 and the synchronous control is continued until the slide reaches the terminating point (corresponding to crank angle θ2 in the case shown in FIG. 5) of the formation zone AW. The sub motor 25 is controlled in synchronization with the speed of the main motor 15 which rotates at the preset motor speed Va of the formation zone AW during the formation phase. Although the main motor 15 decelerates as the dynamic energy of the flywheel 12 is discharged during this formation phase, the control of the sub motor 25 is also synchronized with this deceleration. Thereafter, in Step S6, when the slide has reached the terminating point of the formation zone AW, the clutch 11 is disengaged so that the motion control only by the sub motor 25 starts again.

In Step S7, only the sub motor 25 is controlled so as to rotate at the preset motor speed for each stage of the motion, from the terminating point of the formation zone AW to the waiting point. This causes the slide to move with the crank motion corresponding to the speed of the sub motor 25. In Step S8, a check is made to determine whether or not an instruction indicative of a stop at the waiting point has been issued, and if not, the program returns to Step S3 to repeat the foregoing steps. If the stop instruction has been issued, the slide comes to a stop temporarily in Step S9 when it has reached the waiting point. Thereafter, the program returns to Step S2 to repeat the foregoing steps. It should be noted that the check as to whether the stop instruction has been issued is carried out based on ON/OFF signals from a waiting point switch (not shown), or based on a waiting point stop instruction released from an external host management controller (not shown).

Next, the operation and effects of the above arrangement will be described.

In the formation zone, the clutch is engaged to bring the main motor 15 rotating at a speed conformable to forming conditions into engagement with the drive shaft 3 and the sub motor 25 is driven in synchronization with the speed of the main motor 15. Thus, the energy required for the formation process is supplied by the dynamic energy of the flywheel 12 which is rotatably driven by the main motor 15. Therefore, the main motor 15 may have power equivalent to that of the conventional motors. In the non-formation zone, the clutch is disengaged to disconnect the main motor 15 and the flywheel 12 from the drive shaft 3 so that the load inertia of the drive system of the slide becomes very small. By virtue of this, the control characteristics (e.g., responsibility and stability) of the motion control by the sub motor 25 become excellent, so that high-speed control can be performed with small power and, in consequence, overall cycle time can be decreased. In addition, since the motion control can be performed with the small-sized sub motor 25, the drive unit can be miniaturized which leads to cost reduction.

Further, since the speed of the slide within the formation zone is controlled by the main motor 15 and the speed of the slide within the non-formation zone by the sub motor 25, the slide speed conformable to processing conditions and the slide speed for decreasing cycle time can be independently controlled. Accordingly, the formation speed conformed to the optimum processing conditions and short cycle time are compatible with each other and as a result, high product quality and improved productivity can be both ensured.

In addition, since only the formation speed can be reduced while shortening overall cycle time, noise can be reduced by reducing the work touch speed of the slide. For instance, the difference between the speed in the non-formation zone and the formation speed according to the invention is 40% or more of the speed difference presented by the conventional crank drive, while the conventional link drive provides the speed difference which is up to about 30% of the speed difference of the conventional crank drive. Technically, it is possible for the invention to provide the speed difference which is 100%, that is, the same level as that of the fully servo-driven press.

Further, when the slide has reached the formation zone, the speed of the sub motor 25 is substantially equalized to the speed of the main motor 15 and thereafter, the clutch 11 is engaged, thereby connecting the drive system comprising the main motor 15 to the drive system comprising the sub motor 25. Therefore, noise and shocks occurring at the time of clutch engagement can be lessened, which leads to an improvement in the wear life of the clutch 11.

Where a tandem press line is constructed in which a plurality of presses according to the invention are arranged in series and a workpiece carrying robot or the like is disposed between every two presses, since the cycle times of the presses can be adjusted to substantially the same value through the motion control by the sub motor 25 of each press, it is no longer necessary to temporarily stop presses having short cycle times at their respective waiting points to synchronize them like the case of the conventional tandem press line. As a result, the synchronous operation of the whole line can be facilitated and speeded up with the cycle time of the whole line being decreased.

Additionally, where the press of the present invention is proved with a transfer feeder and used as a transfer press, since the motion in the non-formation zone is controlled only by the sub motor 25, it becomes possible to flexibly cope with the speed required by the transfer feeder. More specifically, the number of strokes of the whole line during alternate driving of the press and transfer feeder can be increased, in other words, the operation is speeded up for example by decreasing the cycle time of the press itself. Alternatively, the operating time of the transfer feeder may be increased by reducing the slide speed in the non-formation zone so that the feeding amount of the feeder can be increased.

According to the invention, modification of an existing press (i.e., retrofitting) involves small-scaled reconstruction, compared to the case where a press is converted into a link-drive structure. If a press is converted into a link-drive structure, it is necessary to disassemble the existing drive shaft, gear 4, gears 5*a*, 5*b*, main gears 6*a*, con' rods and others to attach new link mechanism parts. In contrast with this, conversion into the structure of the invention can be simply done through the following procedure: only the existing drive shaft is disassembled; a new drive shaft 3, to which a clutch can be attached at one end and the gear 19 and the brake can be attached at the other end, is mounted; and the gear box 21 having the gear 22, the reducer 23 and the like and the sub motor 25 are mounted. Accordingly, the reconstruction is very simple and can be done at low cost in a short period of time.

While the present embodiment has been discussed with a case where the motion in the formation zone is determined by the motor speed, starting point and terminating point of each stage, the invention is not limited to this but may be applied to, for instance, a case where the motion in the formation zone is determined by the slide speed (constant speed), starting point and terminating point of each stage and the wait time at the terminating point of each stage and actual control is performed based on motion data such as set slide speeds and slide start points.

The transmission mechanism for the slide drive unit is not limited to the eccentric mechanism described earlier in the present embodiment. The invention is applicable to cases where an eccentric mechanism having other structure, a crank mechanism or a link mechanism is used as the transmission mechanism for the slide drive unit.

While the invention has been presented in conjunction with a case where one sub motor 25 is used, the invention is not limited to this but may be applied to cases where a plurality of sub motors 25 are employed and driven in synchronization. In this case, the plurality of sub motors may drive the same shaft or different shafts.

As described earlier, the invention has the following effects.

Since the press drive unit comprises, two drive systems, that is, the first drive system for driving the slide by transmitting the dynamic energy of the main motor and the flywheel through the clutch and the second drive system for driving the slide by the sub motor without use of a clutch, the great pressing force (processing energy) and suitable formation speed required for the formation zone and the fast response and speeding up of the slide motion control required for the non-formation zone can be both accomplished independently. As a result, products of high quality can be manufactured and improved productivity can be ensured.

Within the non-formation zone, the slide is disconnected by the clutch from the first drive system comprised of the flywheel having great inertia and the slide motion is accurately controlled only by the sub motor of the second drive system. Therefore, the press can be driven at high speed with a small-power motor and the cycle time of the press can be reduced as a whole so that the slide drive unit and the overall press can be miniaturized and produced at low cost. Within the formation zone, a great pressing force is obtained by releasing the dynamic energy of the main motor and the flywheel to the slide drive shaft through the clutch, and therefore high pressurization capability can be effectively utilized. In addition, since the main motor is driven at the optimum formation speed conformable to workpiece processing conditions and the sub motor of the second drive system is controlled in synchronization with the rotational speed of the main motor within the formation zone, processing can be carried out at the optimum formation speed in spite of the high speed in the non-formation zone, so that compatibility between high product quality and improved productivity (a reduction in the cycle time) can be easily attained.

What is claimed is:

1. A press drive unit for forming a workpiece comprising:

a drive shaft coupled to a slide through a specified power transmission mechanism;

a first drive system for rotationally driving a flywheel with a main motor and driving the drive shaft through a clutch disposed between the flywheel and the drive shaft;

a second drive system for driving the drive shaft at variable speed with a sub motor comprising an servo motor; and a controller for controlling a motion of the slide, the controller having a slide position sensor, a rotary cam unit, and a motion setting means connected thereto, wherein the slide motion of the slide consists of a formation zone which exists in the vicinity of a bottom dead center of the slide, and in which the slide is involved in forming the workpiece and a non-formation zone which exists outside the vicinity of the bottom dead center of the slide, and in which the slide is not involved in forming the workpiece, wherein, in the non-formation zone of the slide motion, only the sub motor is controlled based on a set slide motion set by the motion setting means to drive the drive shaft, the clutch is disengaged in the non-formation zone, and wherein the sub motor drives the drive shaft synchronously with the main motor when the slide motion is in the formation zone, the clutch is only engaged in the formation zone for performing two-motor driving by synchronous control of the main motor and the sub motor until the slide reaches a terminating point of the formation zone.

2. The press drive unit for forming a workpiece according to claim 1, wherein driving is carried out with the second drive system atone in the non-formation zone of the slide motion.

* * * * *